US009044050B2

(12) United States Patent
Touzjian

(10) Patent No.: US 9,044,050 B2
(45) Date of Patent: Jun. 2, 2015

(54) MAGNETICALLY ASSEMBLED HOOKAH

(71) Applicant: Vicken Touzjian, Tarzana, CA (US)

(72) Inventor: Vicken Touzjian, Tarzana, CA (US)

( * ) Notice: Subject to any disclaimer, the term of this patent is extended or adjusted under 35 U.S.C. 154(b) by 282 days.

(21) Appl. No.: 13/653,374

(22) Filed: Nov. 14, 2012

(65) Prior Publication Data

US 2014/0130811 A1 May 15, 2014

(51) Int. Cl.
*A24F 1/30* (2006.01)
*A24F 1/32* (2006.01)

(52) U.S. Cl.
CPC .... *A24F 1/32* (2013.01); *A24F 1/30* (2013.01)

(58) Field of Classification Search
CPC ..... A24F 1/30
See application file for complete search history.

(56) References Cited

U.S. PATENT DOCUMENTS 6,474,342 B1 * 11/2002 Rennecamp ..... 131/241
8,714,162 B1 * 5/2014 Johnson ..... 131/328
2006/0272658 A1 * 12/2006 Mehio ..... 131/173
2012/0180803 A1 * 7/2012 Beloni ..... 131/173
2013/0220350 A1 * 8/2013 Zakayan ..... 131/257

FOREIGN PATENT DOCUMENTS

DE 102009022978 A1 * 6/2011

OTHER PUBLICATIONS

DE 102009022978 Translation, Zorsoeker, Jun. 2011.*

* cited by examiner

*Primary Examiner* — Richard Crispino
*Assistant Examiner* — Eric Yaary
(74) *Attorney, Agent, or Firm* — Trojan Law Offices

(57) ABSTRACT

The present embodiments describe a magnetically assembled hookah. The magnetically assembled hookah can have one or more magnetic attachment means that removably couple the parts of the hookah together. The magnetic attachment means generally comprises a magnetic material or a magnet that connects with another magnet or ferromagnetic material. The magnet, magnetic material, or ferromagnetic material can be incorporated into the components of the hookah or be a separate component of the hookah. As a non-limiting example, the magnetic attachment means can include a separate body member that is made of a magnetic or ferromagnetic material to connect with another hookah component at least partially comprised of a magnetic or ferromagnetic material.

14 Claims, 6 Drawing Sheets

MAGNETICALLY ASSEMBLED HOOKAH

BACKGROUND OF THE INVENTION (1) Field of the Invention

The present invention relates to a smoking apparatus, and more specifically, a magnetically assembled hookah.

(2) Description of the Related Art

Hookahs date back centuries and are still popular today. Traditional hookahs are generally used to smoke flavored tobacco and consist of a number of components. The parts of a hookah include a bowl to hold the tobacco and coals, a plate or tray below the bowl to capture fallen ashes, a sealed base or vase to hold water that cools and humidifies tobacco smoke drawn through a channel within the hookah, and a hose to draw the tobacco smoke into the mouth of a person using the hookah. Hookahs may also include a valve to release smoke that has not been inhaled by the user.

Hookahs known in the prior art do not allow for quick and easy assembly and disassembly, while providing reinforced attachment, of several hookah components. For example, hookahs known in the art such as the one described in U.S. Pat. No. 7,827,995 describe an interlocking stem and base assembly. This hookah requires manufacturing of a specially designed interlocking element built into the stem and base of the assembly and does not provide reinforced attachment of other components of the hookah.

Therefore, what is needed in the art is a hookah using electromagnetic forces to connect and disconnect one or more hookah parts. With these goals in mind, the inventor has created an easy to assemble hookah made of multiple connecting components that utilize various methods of magnetic attachment.

BRIEF SUMMARY OF THE INVENTION

The present invention describes a magnetically assembled hookah comprising a magnetic attachment means, wherein the magnetic attachment means comprises a magnet and a ferromagnetic material. The ferromagnetic material comprises a material attracted to the magnet, such as a metal or a second magnet. The magnetic attachment means removably couples the two or more hookah components together.

In one embodiment, the stem and bowl are connected via a magnetic attachment means. In another embodiment, the base and stem are connected via a magnetic attachment means. In yet another embodiment, the hose and hookah hose adapter are connected via a magnetic attachment means. The magnetically assembled hookah can have one or a combination of more than one of these pairs of magnetically attached components. In addition, the hookah can include a tray positioned between the stem and bowl that either does not interfere or alternatively assists with the magnetic attachment. In some embodiments, tray itself can be made of ferromagnetic material.

In certain embodiments, the magnetic attachment means can include a separate component of the hookah. In one embodiment, the separate component comprises a body having an aperture through it, which can connect with another hookah component. In an alternative embodiment, the magnetic attachment means can include a flexible body comprising a first and second arm capable of movement between an open and a closed position. Alternatively, the body can have a first and second arm, and a hinge mechanism pivotally coupling the first and second arms together for pivotal movement between an open position and a closed position. Each of said first and second arms can include a handle to assist the pivotal movement of the arms. In all of these embodiments, the body can substantially or partially surround a component of the hookah proximate to where magnetic attachment is desired, or the body can be positioned between the magnetically attached components.

In other embodiments, a separate component for magnetic attachment is not necessary. At least a portion of each component desired to be connected can comprise a magnetic or ferromagnetic material such that the components themselves are attracted toward one another. For example, the magnetic attachment means can include at least a portion of one component that comprises a magnet or magnetic material and at least a portion of a second connecting component that comprises a ferromagnetic material.

DETAILED DESCRIPTION OF THE INVENTION

The present invention overcomes disadvantages of the prior art, as identified and disclosed by the inventor, by providing a hookah with magnetically assembled parts. The detailed description set forth below in connection with the appended drawings is intended to provide example embodiments of the present invention and is not intended to represent the only forms in which the invention may be constructed or utilized.

Some embodiments of the invention will be described in detail with reference to FIGS. 1-10C. Additional embodiments, features, and/or advantages of the invention will become apparent from the description or may be learned by practicing the invention. The drawings in the figures are not necessarily drawn to scale and have like numerals referring to like features through both the drawings and the description. The terms "connected to" in this application can mean either a direct or indirect connection. The connection can be a permanent or detachable connection.

Figure 1:
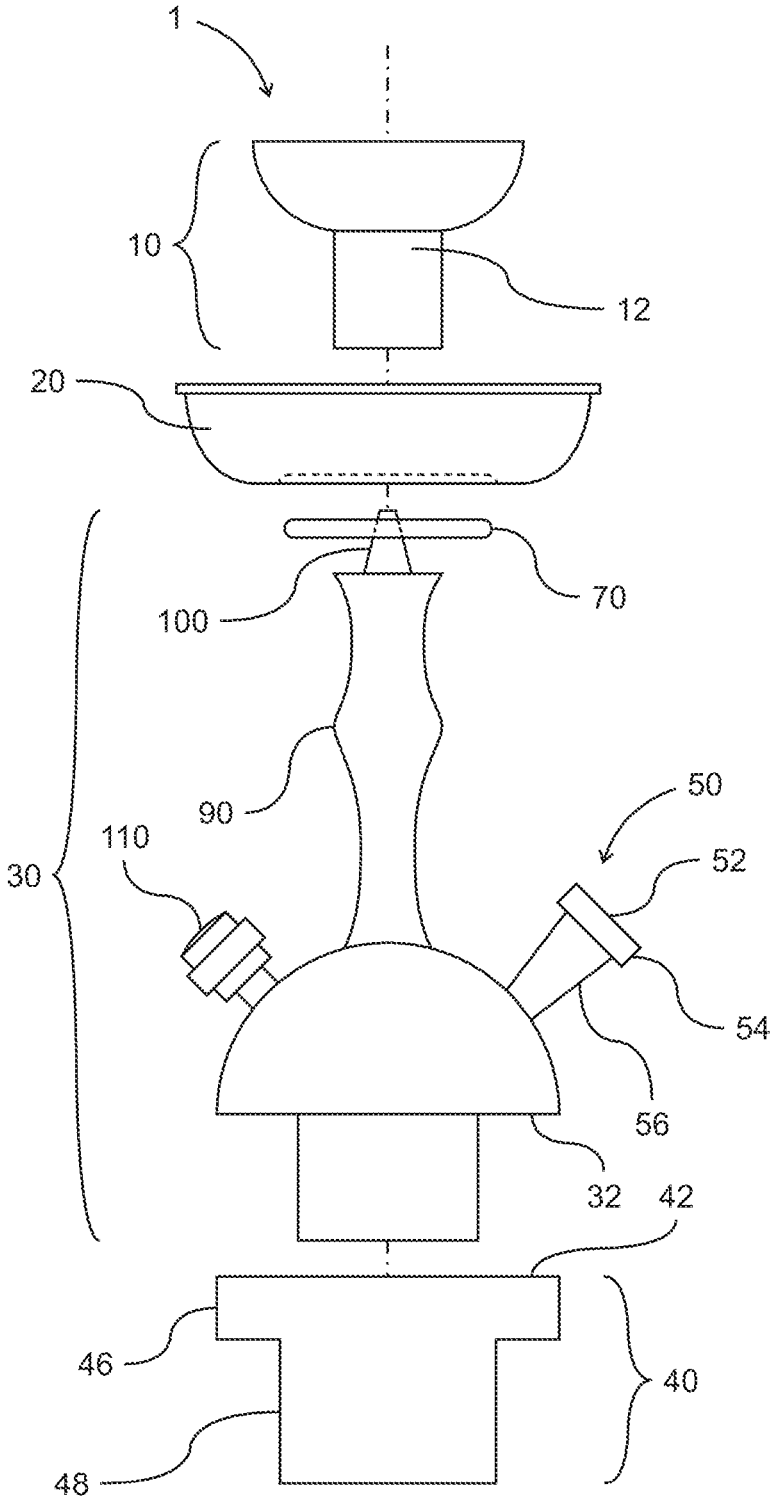
FIG. 1 illustrates an embodiment of a magnetically assembled hookah according to the present invention.

The main components of the hookah 1 are shown in FIG. 1. The hookah 1 can include one or more the following components. A bowl 10 is at the top of the hookah 1. The bowl 10 holds coal and tobacco or other smoking material used while smoking from the hookah 1. A tray 20 can be placed below the bowl 10 to catch falling ashes from the bowl 10. A stem 30 that connects the bowl 10 and a base 40 of the hookah 1 can include an elongated body 90. The stem 30 may include a rubber gasket that inserts into the base 40 to create an airtight seal between the stem 30 and the base 40, which holds water within it.

Figure 10C:
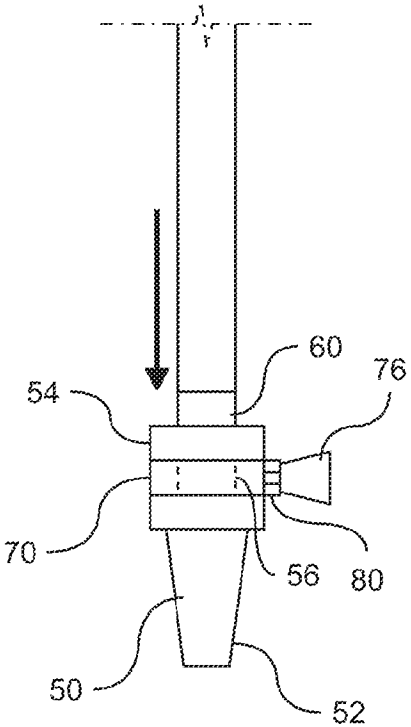
FIG. 10C illustrates an embodiment of a hose adapter and a hose of a magnetically assembled hookah connected according to the present invention.
Figure 10B:
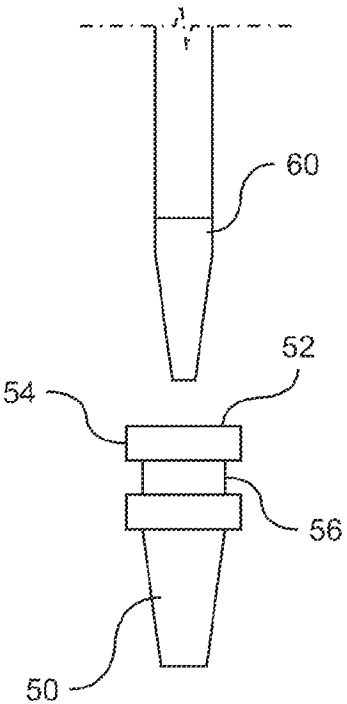
FIG. 10B illustrates an embodiment of a hose adapter and a hose of a magnetically assembled hookah disconnected according to the present invention.
Figure 10A:
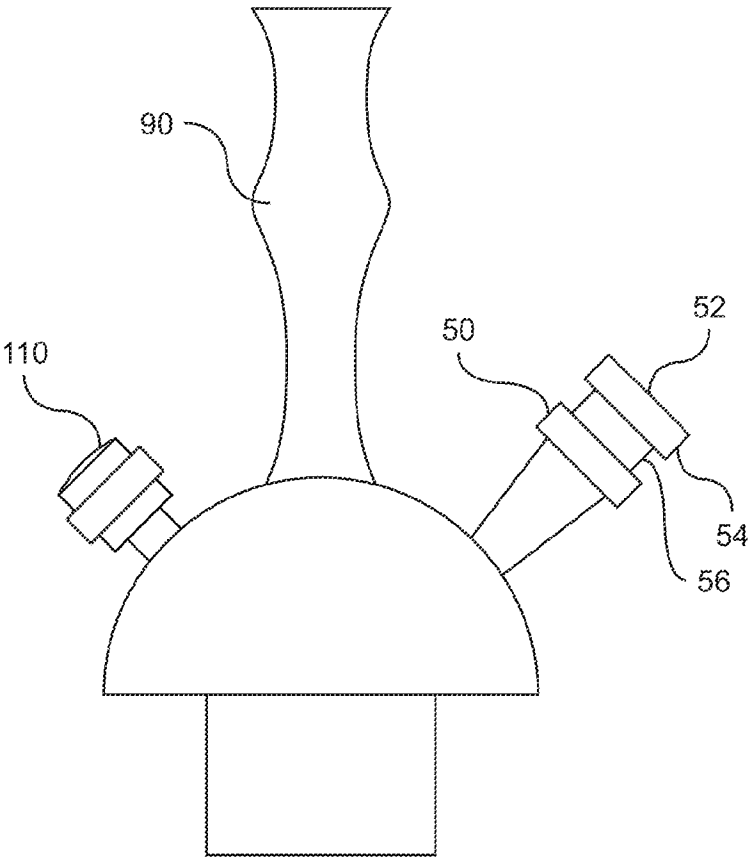
FIG. 10A illustrates an embodiment of a hose adapter of a magnetically assembled hookah connected according to the present invention.

A hose (not shown) can be connected to the stem 30 via the hose adapter 50 (FIGS. 10A-C illustrate the connection between the hose and hose adapter 50). When the user inhales smoke through the hose, air is pulled from the bowl 10, into the stem 30 and passes through a tube in the stem 30 that extends into water held in the base 40. Smoke passes through the water, which cools and humidifies the smoke before it is inhaled through the hose.

In general, the hose can be a flexible tube that is used to draw air through the bowl 10 and stem 30 of the hookah and then to draw smoke into the user's mouth. The length of the hose and water held in the base 40 allows the smoke to cool before it is drawn in by the user. One end of the hose is connected to the stem 30 via a hose adapter 50 and the other end is free for the user to draw in smoke and may be fitted with a mouthpiece.

The bowl 10, stem 30, base 40, and hose allow for airflow into the bowl 10, through the stem 30, into the base 40 and out through the hose connected to the stem 30. The components can be made in any suitable size and shape and may feature any ornamental designs.

Other components known in the art can be used with the hookah 1. For example, a windscreen can cover the bowl 10 to prevent ash from flying from the bowl 10 and prevent increasing the temperature or burning of the coal in the bowl 10. The hookah 1 can also include a purge valve 110 connected through the stem 30 to the air in the base 40 to purge unused smoke in the base 40. Grommets can be used between components of the hookah 1 to better seal the connections between the hookah parts.

The magnetically assembled hookah 1 can have one or more magnetic attachment means that removably couple certain components of the hookah together. Generally speaking, there can be one or more couplings of magnetically attached hookah parts. The magnetically assembled hookah 1 can utilize any one pair magnetically attached parts, or a combination of one or more of magnetically attached parts. One magnetic attachment means can connect the stem 30 and bowl 10 of the hookah 1, these pairing parts are shown in FIG. 1. Another magnetic coupling, shown in FIG. 1 and FIGS. 5-9 can connect the base 40 and stem 30 of the hookah 1. Yet another magnetic attachment means, shown in FIG. 10, can connect a hose adapter 50 with a hose 60 of a hookah 1. Thus, the hookah 1 can have a magnetically attached base 40 and stem 30, a magnetically attached stem 30 and bowl 10, a magnetically attached stem 30, tray 20, and bowl 10, a magnetically attached hose 60 and hose adapter 50, or any combination of one or more of these magnetically attached parts.

The magnetic attachment means comprises a magnet and a ferromagnetic material. The ferromagnetic material comprises a material attracted to the magnet, such as a metal or a second magnet. Thus the attachment may involve, but is not necessarily limited to a magnet and a metal attracted to the magnet, or two magnets. As described herein, the magnetic attachment means is not necessarily a single component of the hookah 1. The magnetic attachment means can comprise one or more hookah components that have the magnet and ferromagnetic materials incorporated into them. Both the magnet can be incorporated into or connected with one component of the hookah 1 and the ferromagnetic material can be incorporated into or connected with another component of the hookah 1. Alternatively, the magnetic attachment means can include a separate component, shown by way of example in FIGS. 2-4, that is either comprised of a magnetic or ferromagnetic material which is attracted to another magnet or ferromagnetic material incorporated into or connected with another component of the hookah 1. The separate component can be a magnet or ferromagnetic material formed in any shape. Several embodiments of a separate element of the magnetic attachment means are shown in FIGS. 1, 2-4, 6-9 and 10C.

The magnet of the magnetic attachment means may be a separate magnet connected to a hookah component or a magnet or magnetic material incorporated into a hookah component. The magnet can also comprise a combination of one or more magnetic materials and one or more non-magnetic materials, so long as the material exerts an electromagnetic force. In another embodiment, a magnet may be integrally formed with a hookah component as a single element. Alternatively, the magnet can be a magnetic material that is incorporated into a hookah component. For example, the hookah component can be entirely or at least partially made of a magnetic material. Each reference to a magnet or magnetic attachment means, throughout the specification and claims, can include one or more than one magnet.

For the purposes of this application, a ferromagnetic material is a material that is capable of being attracted to a magnet or magnetic material. As non-limiting examples, the ferromagnetic material can be iron or another metal known in the art to be attracted to a magnet. The ferromagnetic material can also be a second magnet that is attracted to a first magnet. In other words, the magnetic attachment means can comprise a first magnet attracting a second magnet, in which the opposite poles of each first and second magnet face each other to attract one another. In this embodiment, the second magnet is the ferromagnetic material because it is capable of being attracted to a magnet, the first magnet. The ferromagnetic material can also include a combination of ferromagnetic and non-ferromagnetic materials, so long as the ferromagnetic material magnet is attracted to and can connect with a magnet or magnetic material.

As shown in FIG. 1, a magnetic attachment means can include one or more of the following magnetically attached hookah components. The magnetic attachment means can comprise a magnet and a ferromagnetic material. Several embodiments of connection can be used. The magnetic attachment means can include the stem 30 and bowl 10 of the hookah 1. For example, at least a portion of the stem 30 can comprise a magnet or magnetic material and at least a portion of the bowl 10 can comprise a ferromagnetic material, or magnet. In an alternative embodiment, the magnetic attachment means can include a body 70 of a magnet or magnetic material can be placed between the stem 30 and the bowl 10. The body 70 of the magnet or magnetic material can be any shape such that it can fit between the stem 30 and the bowl 10 without blocking the attachment of the stem 30 and bowl 10. In this embodiment, the bowl 10 can connect to the magnet if it is at least partially comprised of ferromagnetic material. Likewise, the stem 30 can connect if it is at least partially comprised of ferromagnetic material. In another embodiment, a body 70 of ferromagnetic material can be placed between the stem 30 and bowl 10 and one or both of the stem 30 and bowl 10 can be at least partially comprised of a magnet or magnetic material. The body 70 of the ferromagnetic material can be any shape such that it can fit between the stem 30 and the bowl 10 without blocking the attachment of the stem 30 and bowl 10.

As shown in FIG. 1, the bowl 10 can have a channel 12. However, the bowl 10 does not require the channel 12 in all embodiments. The channel 12 can comprise the magnetic or ferromagnetic material to comprise a part of the magnetic attachment means. In the alternative, a body 70 of magnetic or ferromagnetic material can be attached or incorporated into the channel. The channel 12 can be any length and have an outer or inner perimeter in any geometric shape. The channel 12 can be separated from the bowl 10 as an individual component of the hookah 1. In another embodiment, the channel 12 can be an integral part of the bowl 10 to form one component of the hookah 1. In such embodiments, the magnetic attachment means includes the channel 12 or portion of the channel 12 that comprises a magnetic material that attaches to the stem 30 comprised of a ferromagnetic material, or vice versa, the channel 12 or portion of the channel 12 that comprises a ferromagnetic material that attaches to the stem 30 comprised of a magnetic material.

The stem 30 of the hookah 1 can have an elongated body 90 with an engaging element 100 at the top end to fit within the channel 12. As a non-limiting example, the engaging element 100 can be a protrusion at the top end of the stem 30 to engage the bowl 10, or the channel 12 of the bowl 10. In an alternative configuration (not shown) the engaging element 100 may extend downward from the channel 12, to fit into an opening defined by the top end portion of the stem 90. The elongated body 90 can be separated from the stem 30 as an individual component of the hookah 1 or can be an integral part of the stem 30 to form one component of the hookah 1. The elongated body 90 can be also separated from the engaging element 100 as individual components of the hookah 1 or can be formed together as one component of the hookah 1. All three components, the stem 30, elongated body 90, and engaging element 100 can be separate components or form one component of the hookah 1.

Depending on the placement of the magnet and ferromagnetic materials in the other components of the hookah 1, the elongated body 90 can be comprised of a magnetic or ferromagnetic material, or any other suitable non-magnetic material. Thus, the magnetic attachment means can include the elongated body 90 that is at least partially comprised of a magnetic material that attaches to the bowl 10 or portion of the bowl 10 that comprises a ferromagnetic material, or vice versa, the elongated body 90 that is at least partially comprises a ferromagnetic material that attaches to the bowl 10 or portion of the bowl 10 that comprises a magnetic material. In one embodiment, both the elongated body 90 and the bowl 10 comprise magnets.

In a particular embodiment, the engaging element 100 can at least partially comprise of a ferromagnetic material that attaches to the bowl 10 or portion of the bowl 10 that comprises a magnetic material, or vice versa. In a particular embodiment, both the engaging element 100 and the bowl 10 comprise magnets.

The engaging element 100 need only have an outer perimeter that is smaller than the inner perimeter of the channel 12 to fit within the channel 12 to engage the bowl 10. The engaging element 100 and channel 12 need not, but can, have an exact or tight fit between them. The engaging element 100 can thereby prevent the bowl 10 from sliding on the tray 20 and maintain the position of the bowl 10. Depending on the placement of the magnet and ferromagnetic materials in the other components of the hookah 1, the engaging element 100 can also be comprised of a magnetic or ferromagnetic material, or any other suitable non-magnetic material. Accordingly, the magnetic attachment means can include the engaging element 100 that is at least partially comprised of a magnetic material that attaches to the channel 12 or portion of the channel 12 that comprises a ferromagnetic material, or vice versa, the engaging element 100 that is at least partially comprised of a ferromagnetic material that attaches to the channel 12 or portion of the channel 12 that comprises a magnetic material. In one embodiment at least a portion of the channel 12 and at least a portion of the engaging element both comprise magnets.

Figure 2A:
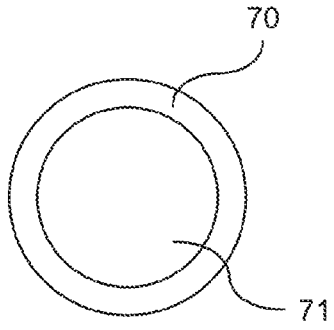
FIG. 2A illustrates an embodiment of a component of a magnetic attachment means of a magnetically assembled hookah according to the present invention.
Figure 2B:
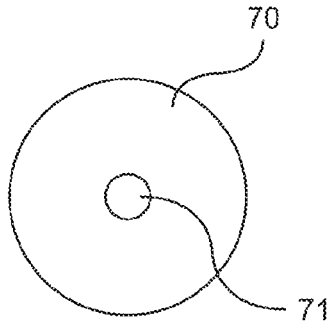
FIG. 2B illustrates an embodiment of a component of a magnetic attachment means of a magnetically assembled hookah according to the present invention.

Also shown in FIG. 1 and FIG. 2, the magnetic attachment means can include an additional separate component of the hookah 1. FIGS. 1 and 2 show a body 70 having an aperture 71 therethrough. The body 70 can be magnetic or ferromagnetic to attract the tray 20 and/or channel 12. As shown, the body 70 can accept the engaging element 100 through its aperture 71 and be positioned between the stem 30 and the bowl 10 to removably couple the bowl 10 and the stem 30. The aperture 71, can vary in size depending on the hookah component it is attached to. For example, the aperture 71 can be larger in size, as shown in FIG. 2A, to accommodate the channel 12, elongated body 90, a portion of the stem 38, or a portion of the base 48. Alternatively, the aperture 71 can be smaller to accommodate an engaging element 100, as shown in FIG. 2B. The body 70 need not be in a disc shape as shown in FIGS. 2A and 2B but can be in any suitable shape, width, and thickness. The body 70 of the magnetic attachment means can have different levels of flexibility ranging from a more rigid to a highly malleable form. Depending on the embodiment of the hookah 1 used, the body 70 can be a magnet or made of magnetic material or ferromagnetic material to attract the other components of the hookah 1. Accordingly, the body and one or more of engaging element 100, stem 30, tray 20, channel 12, bowl 10 or base 40 may attract each other.

Alternatively, the separate component of the magnetic attachment means used with the hookah 1 in FIG. 1 can comprise a flexible body 70 having a first and second arm 72, 74 capable of movement between an open and a closed position. An embodiment of a flexible body 70 is shown in an open position in FIG. 3B, and a closed or semi-closed position in FIG. 3A. The magnetic attachment means coupling the stem 30 and bowl 10 can also utilize a body 70 having a first and second arm 72, 74, and a hinge mechanism 80 pivotally coupling the first and second arms 72, 74 together for pivotal movement between an open position and a closed position. The arms 72, 74 are pivotally coupled together at an end thereof to define a clamping means of the body 70. The arms 72, 74 are movable between an open position wherein the hookah component can be inserted or removed from the body 70 and a closed position wherein a hookah component is secured between the arms 72, 74 of the body 70. Each of the arms can have a handle 76, 78 to assist movement of the arms 72, 74.

Figure 4A:
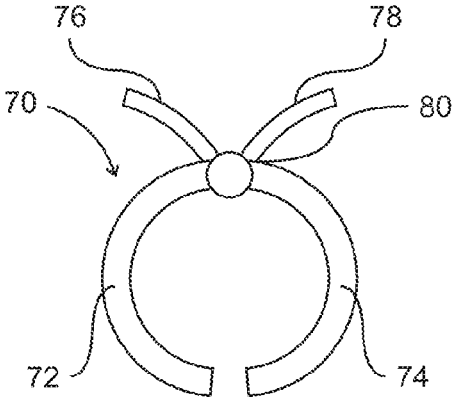
FIG. 4A illustrates an embodiment of a component of a magnetic attachment means of a magnetically assembled hookah in a closed position according to the present invention.
Figure 4B:
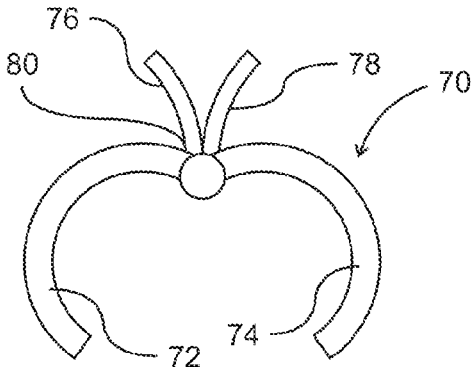
FIG. 4B illustrates an embodiment of a component of a magnetic attachment means of a magnetically assembled hookah in an open position according to the present invention.

One example of this embodiment is shown in an open position in FIG. 4B, and a closed or semi-closed position in FIG. 4A. When in a closed position, the two first and second arms 72, 74 of the body 70 need not, but can, meet or touch one another. In these embodiments utilizing a separate body 70 as part of the magnetic attachment means, the body 70 can partially or substantially surround a part of the hookah 1 proximate to or between the area in which magnetic attachment is desired. For example, the body 70 can partially or substantially surround at least a portion of the bowl 10, e.g., the channel 12 of the bowl 10, or the body can partially or substantially surround at least a portion of the stem 30, e.g., the engaging element 100 of the stem 30. In general, the body maybe used as a part of an attachment means to connect detachable components.

The body 70 can be positioned above or below the tray 20. In one embodiment, the body 70 shown in FIGS. 3A/3B or 4A/4B fits immediately above the tray 20, and attaches to the engaging element 100 in the same fashion shown in FIG. 10C (further described below) where the body 70 engages the hose adapter 56.

Figure 3A:
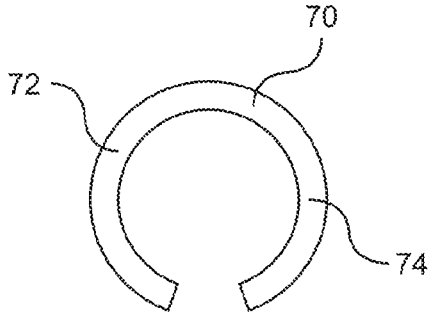
FIG. 3A illustrates an embodiment of a component of a magnetic attachment means of a magnetically assembled hookah in a closed position according to the present invention.
Figure 3B:
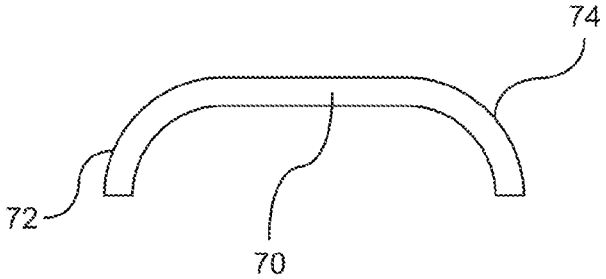
FIG. 3B illustrates an embodiment of a component of a magnetic attachment means of a magnetically assembled hookah in an open position according to the present invention.

In accordance with certain embodiments of the magnetic attachment means having a separate member, the body 70 can be formed like a clamp such that it can at least partially attach around a component of the hookah 1 proximate to the area where magnetic attachment is desired. As shown in FIGS. 3A and 3B, the body 70 can be made of a flexible material in order to attach around a component of the hookah 1. Alternatively, the body 70 can include a hinge mechanism 80 rotatably coupling the first and second arms 72, 74 of the body 70, as shown in FIGS. 4A and 4B. The hinge mechanism 80 can include a pivot pin 80 or a spring-hinge mechanism 80. In embodiments utilizing a spring-hinge, the spring can be positioned at the pivot pin 80 and have opposing ends that extend to the handles 76, 78 of the body 70 such that movement of the handles 76, 78 will control the pivotal movement of the arms 72, 74. In other embodiments, movement of the handles 76, 78 can control the pivotal movement of the arms 72, 74 without the use of a spring hinge. In an alternative embodiment, the body 70 does not include handles 76, 78, and the user can manually open and close the arms 72, 74 connected via a hinge mechanism 80. The hinge mechanism 80 can also utilize any other suitable means for attachment known in the art, such as any clamping mechanism such as a spring clamp or hose clamp, or a tightening screw means that would tighten the body 70 around a hookah component as the screw is turned and tightened. These embodiments, for example, can be utilized with the hookah 1 shown in FIGS. 1, 5-7, and 10.

Also shown in FIG. 1, the hookah 1 can include a tray 20 between the stem 30 and bowl 10. In this embodiment, the magnetic attachment means can utilize any magnetic attachment mechanism described above, or could utilize the tray 20 itself for magnetic attachment of the stem 30 and bowl 10. In one embodiment, the magnetic attachment means can include at least a portion of the tray 20 that comprises the magnet, magnetic material, or ferromagnetic material depending on the composition of the bowl 10 and stem 30, or portions thereof, that are to be connected. The tray 20 can also accommodate a magnetic attachment means that includes a separate body 70 in certain embodiments.

Figures 5, 6, 7:
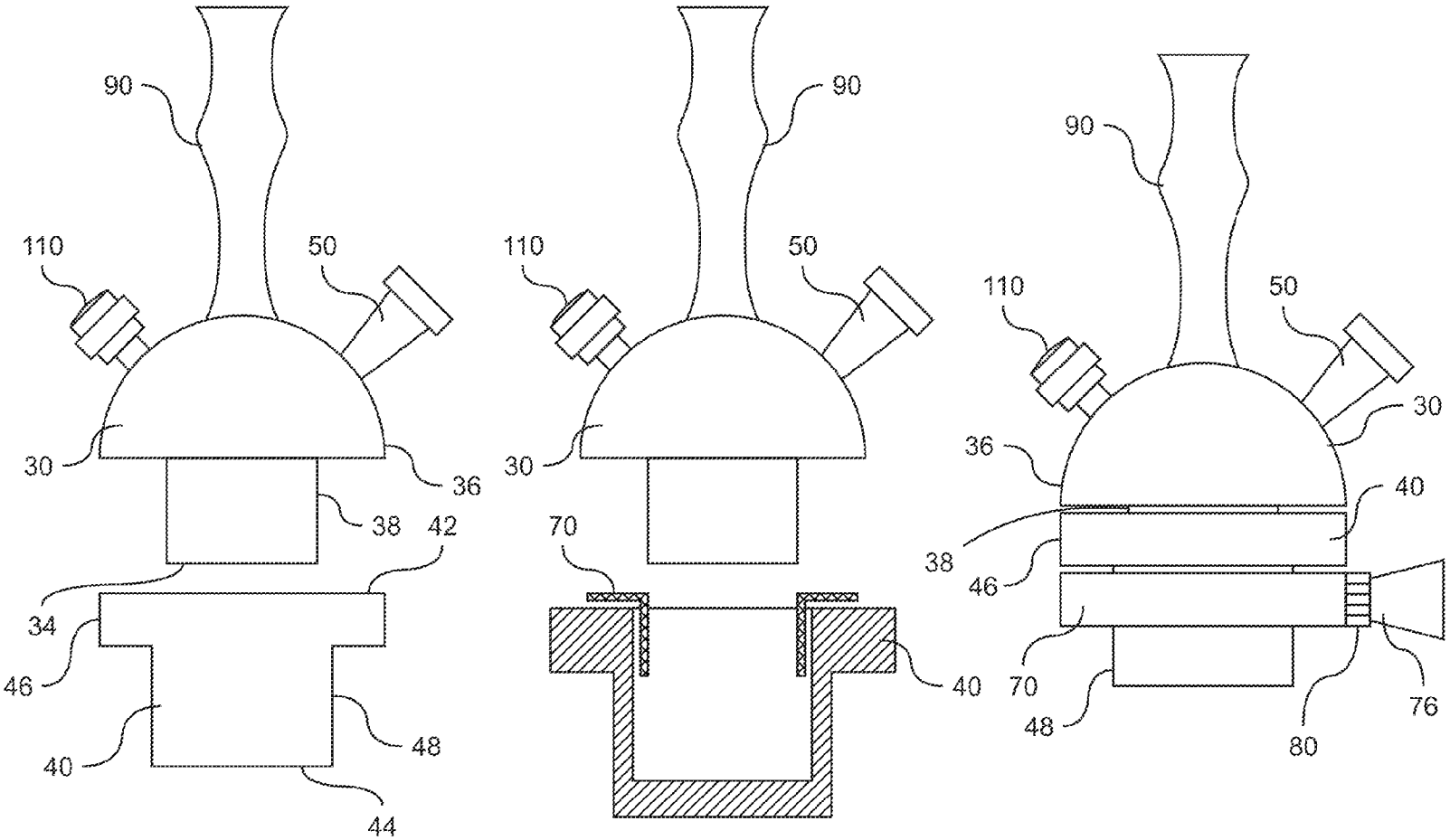
FIG. 5 illustrates an embodiment of a base and stem of a magnetically assembled hookah according to the present invention.
FIG. 6 illustrates an embodiment of a base and stem of a magnetically assembled hookah according to the present invention.
FIG. 7 illustrates an embodiment of a base and stem of a magnetically assembled hookah according to the present invention.
Figure 8A:
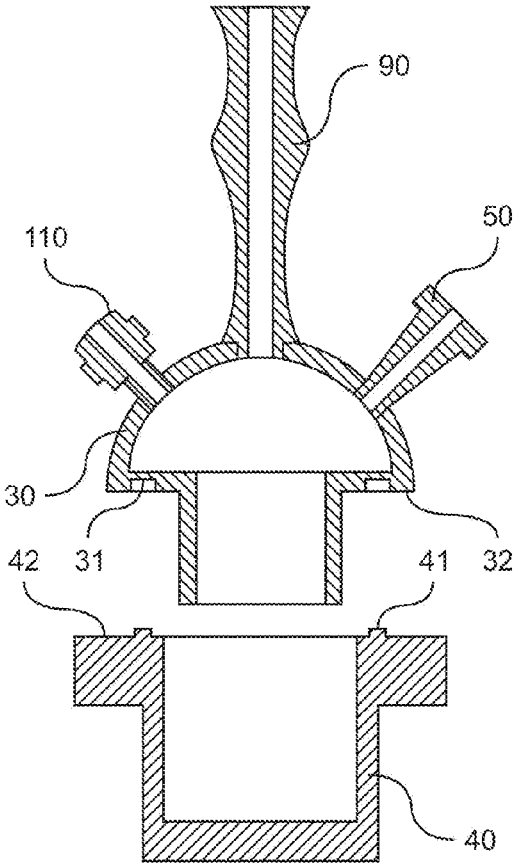
FIG. 8A illustrates an embodiment of a base and stem of a magnetically assembled hookah disconnected according to the present invention.
Figure 8B:
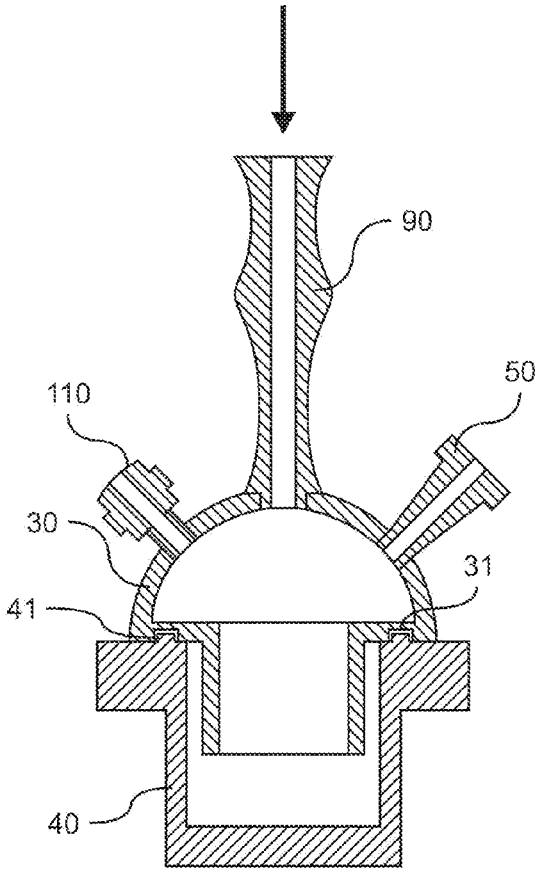
FIG. 8B illustrates an embodiment of a base and stem of a magnetically assembled hookah connected according to the present invention.
Figure 8C:
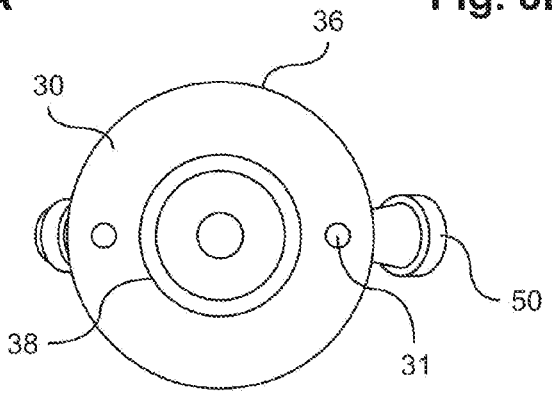
FIG. 8C illustrates a bottom view of a stem of a magnetically assembled hookah disconnected according to an embodiment of the present invention.
Figure 9A:
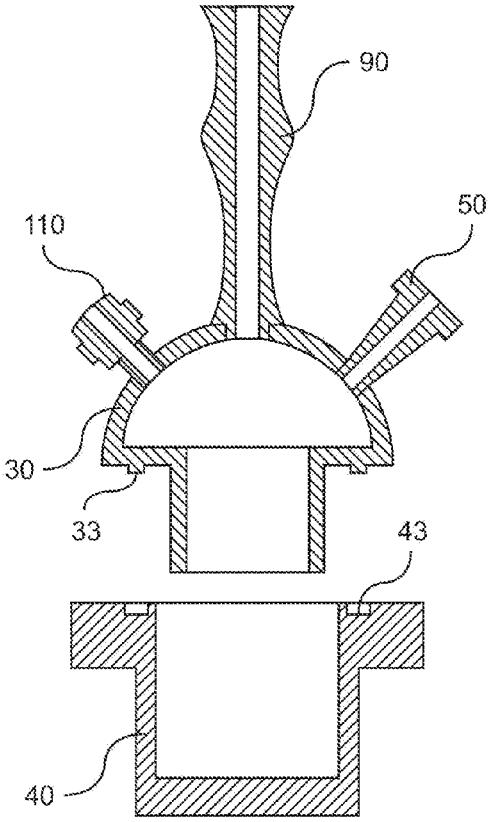
FIG. 9A illustrates an embodiment of a base and stem of a magnetically assembled hookah disconnected according to the present invention.
Figure 9B:
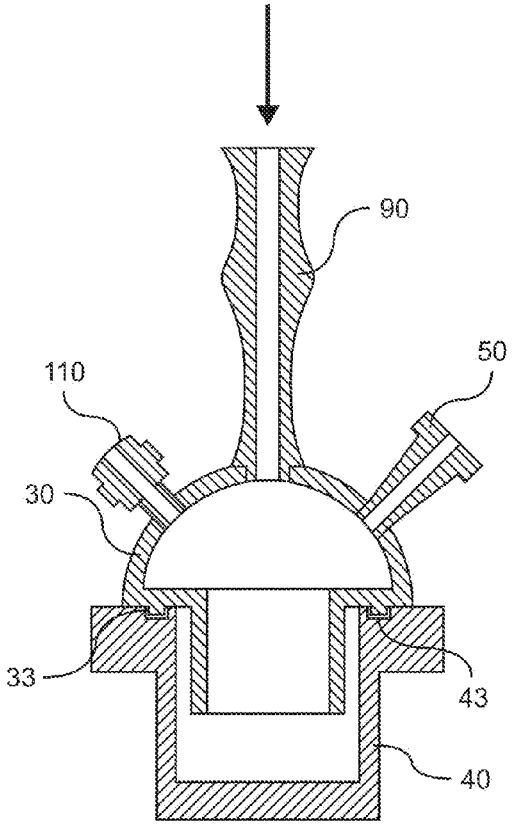
FIG. 9B illustrates an embodiment of a base and stem of a magnetically assembled hookah connected according to the present invention.
Figure 9C:
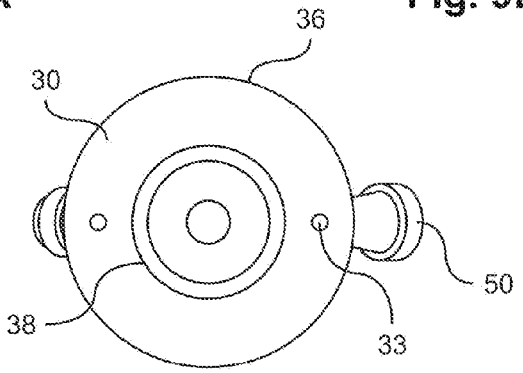
FIG. 9C illustrates a bottom view of a stem of a magnetically assembled hookah disconnected according to an embodiment of the present invention.

Shown in FIGS. 1, and FIGS. 5-9, the magnetic attachment means can comprise a base 40 and stem 30. The base 40 and stem 30 can be magnetically connected using similar magnetic attachment means as described for the stem 30 and bowl 10. The magnetic attachment means can comprise a magnet and a ferromagnetic material. Several embodiments of connection can be used. For example, as shown in FIG. 5, at least a portion of the stem 30 can comprise a magnet or magnetic material and at least a portion of the base 40 can comprise a ferromagnetic material, or magnet. The magnetic and/or ferromagnetic materials can be incorporated into the base 40 and stem 30 in any manner so long as at least some functional attractive behavior can be derived.

In alternative embodiments, such as those shown in FIGS. 6-9, the magnet, magnetic material or ferromagnetic material is placed between the stem 30 and the base 40. Thus the body 70 can be used in at least two different places. As shown in FIG. 6, at least one body 70 comprising a magnetic or ferromagnetic material is placed between the stem 30 and base 40. The stem 30 and base 40 in this embodiment will incorporate materials attracted to the body 70, depending on whether the body 70 is comprised of the magnetic or ferromagnetic material. When the body 70 is at least partially comprised of magnetic material, the stem 30 can connect to the magnet if it is at least partially comprised of ferromagnetic or magnetic material. Likewise, the base 40 can connect if it is at least partially comprised of ferromagnetic or magnetic material. In another embodiment, at least one body 70 comprised of ferromagnetic material can be placed between the stem 30 and base 40 and one or both of the stem 30 and base 40 can be at least partially comprised of a magnet or magnetic material.

Alternatively, the stem 30 can include an outer perimeter 34 having a first elevation 36 and second elevation 38 or the base 40 can include an outer perimeter 44 having a first elevation 46 and second elevation 48. The position of the first and second elevations 36, 38 of the stem 30 and the first and second elevations 46, 48 of the base 40 can be reversed. A separate component of the magnetic attachment means can be used with the hookah 1 as shown in FIGS. 5, 6, and 7. The separate element can comprise a body 70 with an aperture 71 therethrough, or a flexible body 70 having a first and second arm 72, 74 capable of movement between an open and a closed position, shown in FIGS. 3A and 3B. The magnetic attachment means coupling the stem 30 and bowl 10 can also utilize a body 70 having a first and second arm 72, 74, each of the arms 72, 74 having a handle, and a hinge mechanism 80 pivotally coupling the first and second arms 72, 74 together for pivotal movement between an open position and a closed position, shown in FIGS. 4A and 4B. In these embodiments utilizing a separate body 70 in the magnetic attachment means, the body 70 can wrap around a part of the hookah 1 proximate to the area in which magnetic attachment is desired. For example, the body 70 can substantially or partly surround a first or second elevation 36, 38 of the stem 30 or a first or second elevation 46, 48 of the base 40. In FIG. 5, the body 70 can be placed between the stem 30 and base 40, or at least partially surround the second elevation 38 of the outer perimeter 34 of the stem 30. Any of the bodies 70 shown in FIGS. 2A through 4B can be used to at least partially surround the second elevation 38 of the outer perimeter 34 of the stem 30.

In FIG. 7, the body 70 can substantially or partially surround the second elevation 48 of the outer perimeter 44 (shown in FIG. 5) of the base 40, such that the body 70 is placed below where the stem 30 and base 40 meet. For example, the body 70 can be comprised of a magnetic material and the stem 30 can be comprised of a ferromagnetic material or vice versa. The stem 30 is attracted to the body 70 notwithstanding the portion of the base 40 positioned between the stem 30 and body 70. Any of the bodies 70 shown in FIGS. 2A through 4B can be used to at least partially surround the second elevation 48 of the outer perimeter 44 of the stem 40.

Further alternative embodiments are shown in FIGS. 8A-8C and FIGS. 9A-9C. In these embodiments, the stem 30 comprises a bottom surface 32 having at least one recess 31 and the base 40 comprises a top surface 42 having at least one protrusion 41. The at least one recess 31 comprises the magnet or magnetic material and the at least one protrusion 41 comprises the ferromagnetic material, or magnetic material. In another embodiment, shown in FIGS. 9A-9C, the stem 30 can comprise a bottom surface 32 having at least one protrusion 33 and the base 40 can comprise a top surface 42 having at least one recess 43 where at least one recess 43 comprises the magnet or magnetic material and the at least one protrusion 33 comprises the ferromagnetic material, or magnetic material. The recesses 31, 43 and protrusions 41, 33 can be any suitable size or shape.

As shown in FIGS. 10A-10C, the magnetic attachment means comprising a magnet or magnetic material and a ferromagnetic material (or two magnets) can include a hose 60 and hose adapter 50 of the hookah 1 that are to be connected with one another. Specifically, the hose 60 and the hose adaptor 50 can be magnetic or ferromagnetic. In such arrangement, a clamping mechanism is not necessary and thus optional. As shown in FIG. 10B, in one embodiment, the hose adapter 50 has an outer perimeter 52 comprising a first elevation 54 and a second elevation 56. The position of the first and second elevations 54, 56 can be reversed. As with the other magnetically assembled parts of the hookah 1 described herein, the hose 60 and hose adapter 50 can either comprise magnetic and ferromagnetic materials themselves to attract one another (or both can comprise magnets), or the hose 60 and hose adapter 50 can utilize a separate component such as a magnetic or ferromagnetic body 70 shown in FIGS. 2-4. In embodiments utilizing an adapter with an outer perimeter 52 having a first elevation 54 and second elevation 56, the separate body 70 can substantially or partly surround the first or second elevation 54, 56 of the hose adapter 50. The separate body 70 can alternatively substantially or partially surround the hose 60 or a hose adapter 50 having an outer perimeter 52 comprised of one elevation. Any of the bodies 70 shown in FIGS. 2A through 4B can be used to at least partially surround the hose 60 or hose adaptor 50.

While the present invention has been described regarding particular embodiments, it is recognized that additional variations of the present invention may be devised without departing from the inventive concept. A person skilled in the art would appreciate that exemplary embodiments described hereinabove are merely illustrative of the general principles of the present invention and not meant to be a limitation thereof. Other components, configurations, modifications or variations may be employed that are within the scope of the invention.

All terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. The term "adapted to" is drawn to a capability. Thus, it is intended that the invention cover all embodiments and variations thereof as long as such embodiments and variations come within the scope of the appended claims and their equivalents.

What is claimed is:

1. A magnetically assembled hookah comprising:

a stem, a bowl, and a magnetic attachment means, wherein said magnetic attachment means comprises a magnet and an attachment part made of ferromagnetic material and removably couples said stem and said bowl; wherein said magnetic attachment means further comprises (i) a flexible body comprising a first and second arm capable of movement between an open and a closed position or (ii) a body having a first and second arm, and a hinge mechanism pivotally coupling the first and second arms together for pivotal movement between an open position and a closed position.

2. The magnetically assembled hookah of claim 1, wherein said bowl further comprises a channel; and at least a portion of said channel comprises magnetic or ferromagnetic material.

3. The magnetically assembled hookah of claim 2, wherein said stem further comprises an elongated body having an engaging element adapted to engage said channel;

said magnetic attachment means further comprises a body having an aperture therethrough;

whereby said body can accept said engaging element through said aperture and be positioned between said stem and said bowl to removably couple said bowl and said stem.

4. The magnetically assembled hookah of claim 1, further comprising:

a tray between said stem and said bowl, wherein (i) at least a portion of said stem comprises magnetic material and at least a portion of said bowl comprises ferromagnetic material; (ii) at least a portion of said bowl comprises magnetic material and at least a portion of said stem comprises ferromagnetic material; (iii) at least a portion of said tray comprises magnetic material and at least a portion of said bowl comprises ferromagnetic material, (iv) at least a portion of said tray comprises magnetic material, at least a portion of said stem comprises ferromagnetic material, and at least a portion of said bowl comprises ferromagnetic material; (v) at least a portion of said tray comprises ferromagnetic material and at least a portion of said bowl comprises magnetic material; or (vi) at least a portion of said tray comprises ferromagnetic material, at least a portion of said stem comprises magnetic material, and at least a portion of said bowl comprises magnetic material.

5. A magnetically assembled hookah comprising:

a base, a stem, and a magnetic attachment means, wherein said magnetic attachment means comprises a magnet and an attachment part made of ferromagnetic material and removably couples said base and said stem; wherein said magnetic attachment means further comprises (i) a flexible body comprising a first and second arm capable of movement between an open and a closed position, or (ii) a body having a first and second arm and a hinge mechanism pivotally coupling the first and second arms together for pivotal movement between an open position and a closed position.

6. The magnetically assembled hookah of claim 5, wherein (i) at least a portion of said base comprises magnetic material and at least a portion of said stem comprises ferromagnetic material; (ii) at least a portion of said stem comprises magnetic material and at least a portion of said base comprises ferromagnetic material; (iii) said magnet is positioned between said base and said stem and at least a portion of said stem comprises ferromagnetic material; or (iv) said magnetic material is positioned between said base and said stem, at least a portion of said base comprises ferromagnetic material, and at least a portion of said stem comprises ferromagnetic material.

7. The magnetically assembled hookah of claim 5, wherein said base has an outer perimeter comprising a first elevation and a second elevation.

8. The magnetically assembled hookah of claim 5, wherein said stem further comprises a bottom surface having at least one recess;

said base further comprises a top surface having at least one protrusion;

wherein (i) said at least one recess comprises said magnet and said at least one protrusion comprises ferromagnetic material; or (ii) said at least one protrusion comprises said magnet and said at least one recess comprises ferromagnetic material.

9. The magnetically assembled hookah of claim 5, wherein said stem further comprises a bottom surface having at least one protrusion;

said base further comprises a top surface having at least one recess;

wherein (i) said at least one recess comprises said magnet and said at least one protrusion comprises ferromagnetic material; or (ii) said at least one protrusion comprises said magnet and said at least one recess comprises ferromagnetic material.

10. The magnetically assembled hookah of claim 1, further comprising:

a base and a second magnetic attachment means, wherein said second magnetic attachment means comprises a magnet and a second attachment part made of ferromagnetic material and removably couples said base and said stem.

11. The magnetically assembled hookah of claim 1, further comprising:

a hose, a hose adapter, and a second magnetic attachment means, wherein said second magnetic attachment means comprises a magnet and a second attachment made part of ferromagnetic material and removably couples said hose and said hose adapter.

12. The magnetically assembled hookah of claim 5, further comprising:

a hose, a hose adapter, and a second magnetic attachment means, wherein said second magnetic attachment means comprises a magnet and a second attachment part made of ferromagnetic material and removably couples said hose and said hose adapter.

13. The magnetically assembled hookah of claim 10, further comprising:

a tray between said bowl and said stem.

14. A magnetically assembled hookah comprising:

a stem, a bowl, and a magnetic attachment means, wherein said magnetic attachment means comprises a magnet and an attachment part made of ferromagnetic material and removably couples said stem and said bowl;

a hose a hose adapter and a second magnetic attachment means wherein said second magnetic attachment means comprises a magnet and a second attachment part made of ferromagnetic material and removably couples said hose and said hose adapter;

wherein said second magnetic attachment means further comprises (i) a flexible body comprising a first and second arm capable of movement between an open and a closed position, or (ii) a body having a first and second arm, and a hinge mechanism pivotally coupling the first and second arms together for pivotal movement between an open position and a closed position.

* * * * *